US007213580B1

(12) United States Patent
Beyer et al.

(10) Patent No.: US 7,213,580 B1
(45) Date of Patent: May 8, 2007

(54) VEHICLE FUEL SUPPLY SYSTEM

(75) Inventors: Jeff W. Beyer, Grand Blanc, MI (US); John G. Fischer, Goodrich, MI (US); Sharon E. Beyer, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/479,880

(22) Filed: Jun. 30, 2006

(51) Int. Cl.
*F02M 37/04* (2006.01)
*F02M 37/08* (2006.01)

(52) U.S. Cl. ..... 123/509; 123/519

(58) Field of Classification Search ..... 123/509, 123/510, 511, 514, 516, 518, 519, 575, 577
See application file for complete search history.

(56) References Cited

U.S. PATENT DOCUMENTS 4,413,604 A * 11/1983 Tune ..... 123/515
5,336,396 A * 8/1994 Shetley ..... 210/90

* cited by examiner

*Primary Examiner*—Mahmoud Gimie
(74) *Attorney, Agent, or Firm*—Paul L. Marshall

(57) ABSTRACT

A fuel system for a vehicle having a generator includes a fuel reservoir which taps into the main fuel tank. A solenoid pump pumps fuel from the main fuel tank to the reservoir which in turn feeds fuel to the generator. A fuel shut-off valve is provided in the reservoir to prevent overfilling of the reservoir without the need for a fuel level sensor or pump control electronics. The valve is operable to close upon the fuel level reaching the closing height of the valve. Closing of the valve causes the pump to idle, thus stopping the flow of fuel into the reservoir. Fuel is still allowed to flow from the reservoir to the generator, thus allowing uninterrupted running of the generator. When the fuel level in the reservoir dips below the closing height of the valve, the valve opens and the pump again starts pumping fuel into the reservoir.

12 Claims, 3 Drawing Sheets

VEHICLE FUEL SUPPLY SYSTEM

TECHNICAL FIELD

The present invention relates to vehicle fuel systems, and more particularly to a fuel supply system for a vehicle equipped with a generator.

BACKGROUND OF THE INVENTION

Generator-equipped vehicles are known, examples of which include tractor-trailers, tour buses and recreational vehicles or "RVs". These types of vehicles have many of the comforts of home such as interior lighting, stoves, microwaves, refrigerators, bathrooms and televisions, each of which require a source of electricity usually provided by a gasoline powered generator. The vehicle's main fuel tank may be tapped to supply fuel to a fuel reservoir that in turn supplies fuel to the generator even when the vehicle engine is not running. Prior to the present invention, preventing overfill of the fuel reservoir has been accomplished through a return line to the vehicle fuel tank or with a fuel level sensor and associated electronics that connect to the vehicle's ECM (electronic control module) to turn the pump on and off, and which therefore add to the vehicle cost.

It would therefore be desirable to have a fuel supply system for a generator-equipped vehicle that does not require a fuel return line to the vehicle fuel tank, or a fuel level sensor and associated electronics of the prior art.

SUMMARY OF THE INVENTION

The present invention successfully addresses the above need by providing a fuel system for powering both the engine and a generator of any generator-equipped vehicle and which controls, without a fuel level sensor or associated fuel level control electronics, the fuel level in the fuel reservoir which supplies fuel to the generator.

More particularly, in an embodiment of the invention, a fuel system is provided having a primary fuel tank with a first fuel line for supplying fuel to the engine of the vehicle. A second fuel line extends from the primary fuel tank and delivers fuel to a fuel reservoir which in turn supplies fuel to a generator. A solenoid fuel pump is provided along the second fuel line to pump fuel from the primary tank to the fuel reservoir. To prevent overfill of the reservoir, a fuel shut-off valve is provided at the appropriate height in the reservoir. The valve is normally open and will close when the fuel level reaches the closing height of the valve.

The valve includes a valve body having a movable component that has a predetermined buoyancy in fuel. A spring surrounds the component and has a predetermined spring force which, when combined with the buoyancy force of the component, closes the valve when the fuel level reaches the closing height of the valve. The combined component buoyancy and spring force is greater than the force of fuel flow from the solenoid pump. As such, when the valve closes, the pump stops pumping fuel into the reservoir without the need for electronic control thereof.

With the valve closed and the pump not pumping fuel into the reservoir, fuel still flows from the reservoir to the generator which will thus continue to operate. As the generator uses fuel from the reservoir, the fuel level in the reservoir continues to fall. Once the fuel level has dipped below the valve closing height in the reservoir, the buoyancy force is no longer present and the force of fuel at the valve inlet overcomes the spring force to open the valve and thereby allowing the pump to again pump fuel from the primary fuel tank into the reservoir. This cycle is continuously repeated to permit continuous running of the generator.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
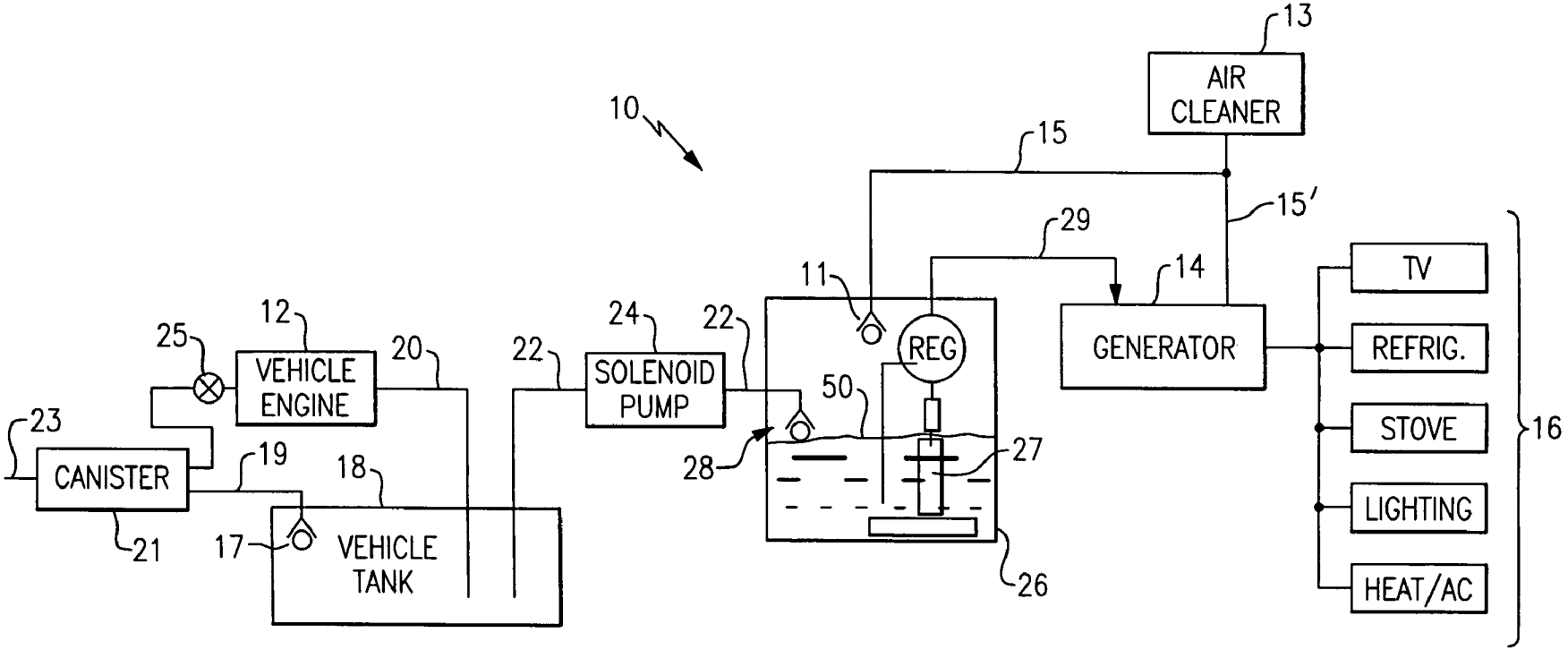
FIG. 1 is a block diagram in accordance with a preferred embodiment of the invention.

Referring now to the drawing, there is seen in FIG. 1 a simplified block diagram of a preferred embodiment of the invention. In the embodiment of FIG. 1, fuel supply system 10 is provided for supplying fuel to a vehicle's engine 12 and also to a generator 14. Such generators 14 are used to power various electrical systems and appliances found in certain vehicles such as RVs and tour buses as explained above. Such electrical systems and appliances may include interior lighting, stoves and microwaves, refrigerators, televisions, bathrooms and heating and air-conditioning, for example, as indicated at 16.

Fuel supply system 10 includes the main vehicle fuel tank 18 including a first fuel line 20 leading to the vehicle engine 12. A second fuel line 22 extends from fuel tank 18 to supply fuel to a fuel reservoir 26 which in turn pumps fuel via a reservoir pump 27 to the generator 14 via third fuel line 29. A solenoid fuel pump 24 is provided along the second fuel line 22 to pump fuel from the primary tank 18 to the fuel reservoir 26. To prevent overfill of the reservoir 26, a fuel shut-off valve 28 is provided at the appropriate height in reservoir 26. Valve 28 opens under the force of fuel entering valve inlet 38 but will close when the fuel level in reservoir 26 reaches the closing height of valve 28.

In the preferred embodiment of FIG. 1, a fuel vapor vent valve 11 is provided in reservoir 26 and leads via line 15 to an air cleaner 13 which also connects to generator 14 via line 15'. A fuel vapor vent valve 17 is also provided in main vehicle tank 18 which leads via line 19 to canister 21 having a fresh air intake 23. Canister 21 connects to a purge valve 25 which also connects to the vehicle engine 12.

Figure 2:
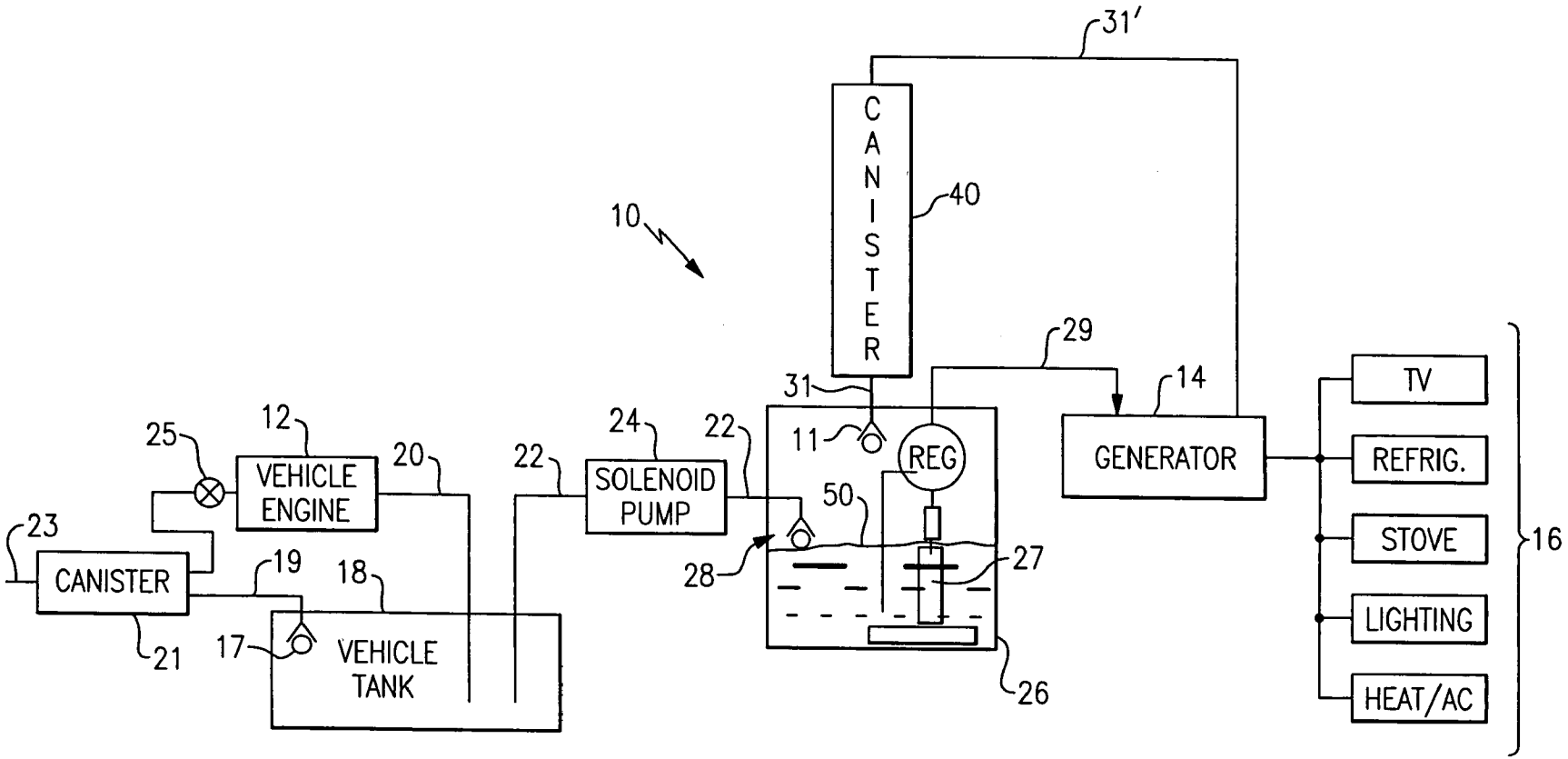
FIG. 2 is a block diagram in accordance with an alternate embodiment of the invention.

In the alternate embodiment of FIG. 2, reservoir fuel vapor vent valve 11 leads via line 31 to a canister 40 which also connects to generator 14.

Figure 4:
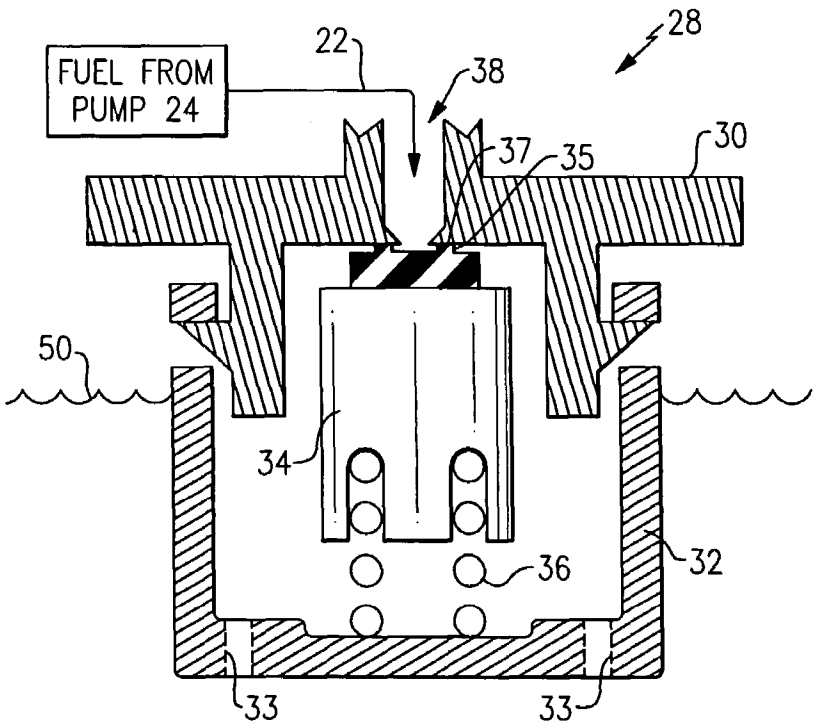
FIG. 4 is the view of FIG. 3 showing the valve in the closed position.
Figure 3:
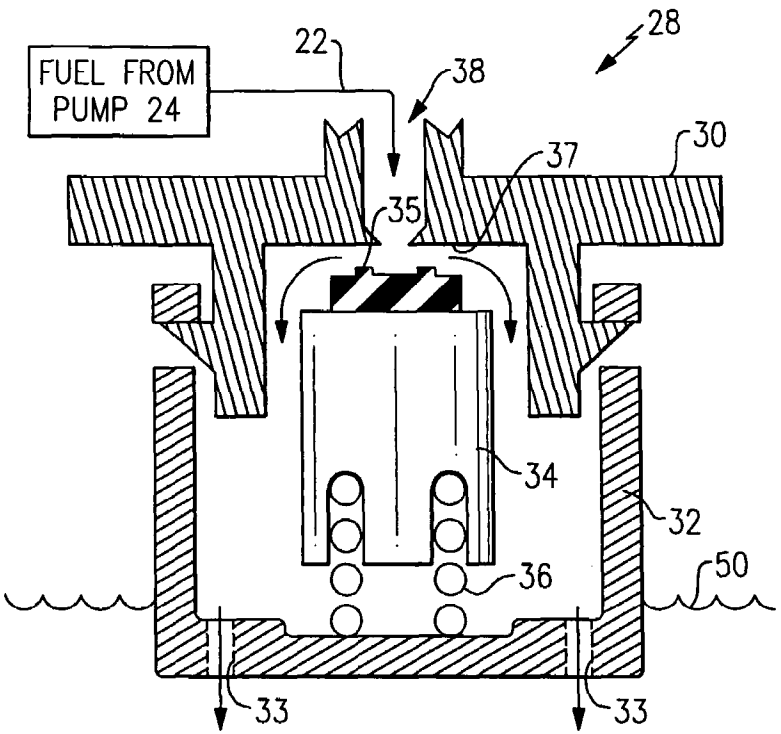
FIG. 3 is a simplified cross-sectional view of an embodiment of a fuel shut-off valve of the present invention with the valve shown in the open position.

Referring to FIGS. 3 and 4, valve 28 includes a valve body having upper and lower parts 30, 32 which snap-fit together, although other valve types and configurations are of course possible. Valve 28 includes a suitably shaped, movable valve component 34 that has a predetermined buoyancy in liquid fuel indicated at 50. A spring 36 surrounds valve component 34 and has a predetermined spring force. When the fuel level in the reservoir 26 is below the closing height of valve 28, component 34 exerts essentially no upward buoyancy force. The force of spring 36 alone is less than the force of fuel entering inlet 38 by pump 24. As such, when the fuel level in reservoir 26 is below the closing height of the valve, component 34 is forced downward to the open position seen in FIG. 3. One or more fuel outlets 33 are provided at the valve body lower part 32 wherethrough fuel flows from the inlet 38 and into the reservoir 26. Thus, when the valve is open, fuel enters the valve through inlet 38, passes over component 34 and spring 36, and exits at fuel outlets 33.

When the fuel level in reservoir 26 reaches the closing height of valve 28, enough fuel is present about component 34 inside valve body 30 that component 34 exerts an upward buoyancy force. The buoyancy force of component 34 and the spring force of spring 36 when combined is greater than the force of fuel flow entering inlet 38 from the solenoid pump 24. As such, when the fuel level reaches the closing height of the valve, the component 34 moves upward to the closed position seen in FIG. 4. In this position, valve seal 35 presses against valve seat 37, closing inlet 38. When the valve 28 closes, the pump 24 is unable to pump fuel into the reservoir 26 and pump 24 will therefore idle when valve 34 is closed. It will therefore be appreciated that the solenoid pump 24 is controlled through the action of valve 28, and therefore does not require any external electronic control logic to switch between pumping and not pumping.

With the valve 28 closed and the solenoid pump 24 not pumping, fuel is still pumped by the reservoir pump 27 from the reservoir 26 through third fuel line 29 to the generator 14 which will thus continue to operate. As the generator 14 uses fuel from the reservoir 26, the fuel level in the reservoir 26 continues to fall. Once the fuel level has dipped below the valve closing height in the reservoir 26, the valve 34 opens due to the lack of a buoyancy force such that the force of the fuel at inlet 38 overcomes the force of spring 36 and moves component 34 to the open position seen in FIG. 3.

Although the specific valve configuration, valve component buoyancy and spring force may vary depending on the specific fuel system design being employed, the following provides an example of acceptable force values:

EXAMPLE 1

Solenoid pump: About 6 PSI. acting on a 1 mm (0.040") valve inlet orifice. Combined component buoyancy and spring force: About 0.07 Newtons.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A fuel system for a vehicle having an engine and a generator, said fuel system comprising:

a) a main fuel tank;

b) a fuel reservoir;

c) a generator;

d) a first fuel line extending between said main fuel tank and said engine;

e) a second fuel line extending from said main fuel tank to said reservoir;

f) a third fuel line extending between said reservoir and said generator;

g) a pump connected to said second fuel line and operable to pump fuel from said fuel tank to said reservoir; and h) a fuel shut-off valve located in said reservoir, said valve operable to move between open and closed positions in response to the fuel level in said reservoir, said pump idling in response to said valve closing.

2. The fuel system of claim 1 wherein said valve includes a movable component having a predetermined buoyancy force in fuel and a spring having a predetermined spring force, said valve having a closing height defined as a level of fuel in said reservoir sufficient to cause said component to exert a buoyancy force, said buoyancy force and said spring force in combination being greater than the force of fuel from said pump such that said valve closes upon the fuel level reaching said closing height of said valve.

3. The fuel system of claim 2 wherein said component exerts no buoyancy force when the fuel level is below said valve closing height and wherein said spring force is less than the force of fuel from said pump such that said valve opens upon the fuel level falling below said closing height of said valve.

4. The fuel system of claim 3 wherein said pump operates at about 6 PSI, said valve has an inlet orifice having a diameter of about 1 mm and said component buoyancy force and spring force combined is about 0.07 Newtons.

5. The fuel system of claim 1 wherein said pump is a solenoid pump.

6. The fuel system of claim 1 and further comprising a second pump positioned in said reservoir, said second pump connected to said third fuel line and operable to pump fuel from said reservoir to said generator.

7. The fuel system of claim 1 and further comprising a fuel vapor vent valve positioned in said reservoir and connected to an air cleaner located outside of said reservoir.

8. The fuel system of claim 7 and further comprising a canister connected to said main fuel tank and to said vehicle engine.

9. The fuel system of claim 8 and further comprising a purge valve connected and positioned between said canister and said vehicle engine.

10. The fuel system of claim 1 and further comprising a canister connected to said main fuel tank and to said vehicle engine.

11. The fuel system of claim 10 and further comprising a purge valve connected and positioned between said canister and said vehicle engine.

12. The fuel system of claim 10 and further comprising a fuel vapor vent valve positioned in said reservoir and connected to a second canister located outside said reservoir, said canister further connected to said generator.

* * * * *